US012539578B2

(12) United States Patent
Valentini

(10) Patent No.: US 12,539,578 B2
(45) Date of Patent: Feb. 3, 2026

(54) PLATE-LIKE BACKING PAD ADAPTED FOR RELEASABLE ATTACHMENT TO A HAND-HELD POLISHING OR SANDING POWER TOOL

(71) Applicant: Andrea Valentini, Milan (IT)

(72) Inventor: Andrea Valentini, Milan (IT)

(73) Assignee: Andrea Valentini, Milan (IT)

( * ) Notice: Subject to any disclaimer, the term of this patent is extended or adjusted under 35 U.S.C. 154(b) by 506 days.

(21) Appl. No.: 17/683,583

(22) Filed: Mar. 1, 2022

(65) Prior Publication Data

US 2022/0305606 A1 Sep. 29, 2022

(30) Foreign Application Priority Data

Mar. 23, 2021 (EP) ..... 21164265

(51) Int. Cl.
*B24D 9/08* (2006.01)
*B24B 23/02* (2006.01)
(Continued)

(52) U.S. Cl.
CPC ..... *B24D 9/08* (2013.01); *B24B 23/022* (2013.01); *B24B 45/006* (2013.01); *B24D 3/002* (2013.01)

(58) Field of Classification Search
CPC ..... B24B 23/028; B24B 23/02; B24B 23/005; B24B 23/00; B24B 23/022; B24B 45/006;
(Continued)

(56) References Cited

U.S. PATENT DOCUMENTS

2004/0009737 A1* 1/2004 Minegar ..... B24B 45/00 451/28
2005/0058518 A1 3/2005 Valentini
(Continued)

FOREIGN PATENT DOCUMENTS

DE 29923017 U1 * 2/2000 ..... B24B 23/02
EP 1 514 644 A1 3/2005
(Continued)

OTHER PUBLICATIONS

English language Abstract of JP5678195B2 found in corresponding application WO2012/055646A1.
(Continued)

*Primary Examiner* — Monica S Carter
*Assistant Examiner* — Kent N Shum
(74) *Attorney, Agent, or Firm* — William J. Barber; WARE FRESSOLA MAGUIRE & BARBER LLP

(57) ABSTRACT

A plate-like backing pad (20) for releasable attachment to a hand-held polishing/sanding power tool (2) includes a center axis (34), a top surface (50) having a resilient plastic damping layer (52) attached thereto, an even bottom layer (22) attached to a bottom surface (56) of the damping layer (52) and adapted for releasable attachment of a polishing/sanding member (24), and an attachment member (38) adapted on the top surface for releasable attachment to a corresponding attachment element (32) of the power tool (2). The top surface has a central region (58) extending around the center axis and an external region (60) surrounding the central region recessed with respect to the external region. The attachment member adapted in the recessed central region with the center axis extending through the attachment member and part of the central region surrounding the attachment member.

14 Claims, 5 Drawing Sheets

(51) Int. Cl.
*B24B 45/00* (2006.01)
*B24D 3/00* (2006.01)

(58) Field of Classification Search
CPC ..... B24B 45/00; B24D 9/08; B24D 3/002; B24D 3/00
See application file for complete search history.

(56) References Cited

U.S. PATENT DOCUMENTS

| | | | | |
|---|---|---|---|---|
| 2013/0157552 | A1* | 6/2013 | Kolthoff | B24D 13/147 451/548 |
| 2019/0240798 | A1* | 8/2019 | Valentini | B24B 23/02 |

FOREIGN PATENT DOCUMENTS

| | | | | |
|---|---|---|---|---|
| EP | 2 052 813 | A1 | 4/2009 | |
| EP | 2 551 056 | A1 | 1/2013 | |
| EP | 3 520 960 | A1 | 8/2019 | |
| EP | 3 520 962 | A1 | 8/2019 | |
| JP | 5 678195 | B2 | 2/2015 | |
| WO | 01/96067 | A1 | 12/2001 | |
| WO | WO-2007051656 | A1 * | 5/2007 | B24B 23/02 |
| WO | 2012/055646 | A1 | 5/2012 | |
| WO | 2019/048732 | A1 | 3/2019 | |

OTHER PUBLICATIONS

English language Abstract of EP2052813A1.
Partial English language translation of JPS5819687.
English language translation of JPS59-128349U.

* cited by examiner

PLATE-LIKE BACKING PAD ADAPTED FOR RELEASABLE ATTACHMENT TO A HAND-HELD POLISHING OR SANDING POWER TOOL

BACKGROUND OF THE INVENTION

1. Field of the Invention

The present invention refers to a plate-like backing pad adapted for releasable attachment to a hand-held polishing or sanding power tool. The backing pad comprises:

- a center axis,
- a top surface,
- a damping layer made of resilient plastic material and attached to the top surface,
- an even bottom layer attached to a bottom surface of the damping layer and adapted for releasable attachment of a polishing or sanding member, and
- an attachment member provided on the top surface and adapted for releasable attachment to a corresponding attachment element of the hand-held power tool, in particular of a tool shaft or of an eccentric element of the hand-held power tool.

2. Brief Description of Related Art

Backing pads of the above-identified kind are well-known in the prior-art. The known backing pads have a top surface with a circular central region extending around the center axis and an essentially ring-shaped external region surrounding the central region. Usually, in the known backing pads the central region protrudes upwards beyond the surrounding external region and forms a central elevation. The reason for the elevation in the central region is that it comprises the attachment member of the backing pad, by means of which the backing pad is releasably attached to a power tool, in particular a polisher or a sander. The attachment member may be in the form of a threaded pin or a recess adapted for receiving and being attached to a corresponding attachment element of the power tool. Preferably, the attachment element is fixedly attached or forms part of a tool shaft or is attached to an eccentric element of the power tool. Preferably, the attachment element is attached to an eccentric element in a manner freely rotatable about the center axis of the backing pad. Backing pads of that kind are known, for example, from EP 2 052 813 A1 EP 3 520 962 A1 and WO 2019/048 732 A1.

If the backing pad is directly attached to the tool shaft of a power tool, it preferably performs a purely rotational working movement. If the backing pad is attached to the tool shaft by means of an eccentric element, it preferably performs a random orbital working movement. The eccentric element is attached to the tool shaft in a torque proof manner so as to rotate about a rotational axis of the tool shaft upon activation of the power tool. The backing pad is attached to the eccentric element in a manner freely rotatable about its center axis. The rotational axis of the tool shaft and the center axis of the backing pad extend parallel and in a distance to each other. When the power tool is activated, the backing pad performs an eccentric movement about the tool shaft's rotational axis. At the same time the free rotation of the backing pad in respect to the eccentric element adds a random rotational movement component of the backing pad about the center axis to the eccentric movement, resulting in the random orbital working movement of the backing pad.

In the case of an attachment member of the backing pad in the form of a recess, the attachment element of the power tool preferably comprises a protrusion having an external circumferential surface with a form corresponding to the form of an internal circumferential surface of the recess, so that the protrusion can be inserted into the recess in an axial direction and held therein in a form-fit connection in a plane extending perpendicular to the center axis. The external circumferential form of the protrusion does not necessarily have to be identical to the internal circumferential form of the recess. It is sufficient, if the protrusion is formed such that it can be inserted into the recess and held therein in a form-fit manner without clearance.

The protrusion may be held in the recess in the axial direction mechanically, e.g. by means of a screw or a nut, or magnetically, e.g. by interacting magnetic elements (e.g. permanent magnet(s) and/or ferromagnetic element(s)). Preferably, the form of the external circumferential surface of the protrusion and the form of the internal circumferential surface of the recess are not rotationally symmetric in respect to the center axis of the backing pad. In this manner, after insertion of the protrusion into the recess in the axial direction, they are connected to each other in a torque proof manner in respect to the center axis of the backing pad. To this end, a torque can be transmitted from the tool shaft or the eccentric element of the power tool to the backing pad, if desired.

In the case of an attachment member of the backing pad in the form of a threaded pin, the attachment element of the power tool preferably comprises a threaded hole having an internal diameter and thread corresponding to an external diameter and thread of the threaded pin. The backing pad may be fixedly attached to the attachment element by means of a threaded connection.

One drawback of the conventional backing pads having an elevation in the central region of the top surface and with the attachment member located in that elevation is that the center of gravity of the backing pad and, hence, of the entire moving masses is rather high, i.e. at a rather large distance from the surface to be worked by means of the power tool and the polishing or sanding member, respectively. The result is that the power tool with the backing pad attached thereto and the polishing or sanding member attached to the backing pad, has a rather unsteady and uneven running and creates a rather large amount of vibrations during intended use of the power tool. In the case of an eccentric element, this is enforced by the fact that the eccentric element has one or more counterweights to compensate for the weight of the backing pad. Due to the elevation of the central region of the backing pad, the centers of gravity of the counterweight(s) on the one hand and of the backing pad on the other hand are spaced apart by a rather large distance resulting in an even more unsteady and uneven running and even larger vibrations of the power tool.

SUMMARY OF THE INVENTION

Starting from the backing pads of the above-identified kind, it is an object of the present invention to provide for a backing pad which provides for a much steadier and more even running of a power tool to which it is attached during the intended use of the power tool.

In order to solve that object, the present invention provides a new backing pad. In particular, starting from the backing pad according to the above-identified kind, the top surface of the backing pad has a central region extending around the center axis and an external region surrounding the central region, that the central region is recessed in respect to the surrounding external region, and that the attachment member is provided in the recessed central region of the top surface with the center axis extending through the attachment member and at least part of the central region surrounding the attachment member.

In contrast to the prior-art backing pads, where the center region protrudes upwards beyond the surrounding external region in an axial direction (i.e. parallel to the center axis), in the present invention, the center region is recessed in respect to the surrounding external region. Hence, the center region extends below an imaginary horizontal plane defined by the surrounding external region. This allows an arrangement of the attachment member of the backing pad much lower and deeper in the backing pad closer towards the bottom layer of the backing pad. Hence, the backing pad may be arranged much closer to the power tool, thereby reducing the distance between moving masses of the power tool in the axial direction. In particular, a counterweight of the eccentric element can be positioned much closer to the backing pad, preferably even at least partially within a depression formed in the top surface by the recessed central region. This leads to the centers of gravity of the counterweight(s) on the one hand and of the backing pad (including the polishing or sanding member) on the other hand are located much closer to each other in the axial direction. The result is that the power tool with the backing pad according to the present invention attached thereto and the polishing or sanding member attached to the backing pad has a much steadier and more even running and creates a much smaller amount of vibrations during intended use of the power tool.

The counterweight corresponding to the weight of the backing pad and the polishing or sanding member attached thereto, is arranged opposite to the center of gravity of the backing pad in respect to a rotational axis of the power tool (or of the tool shaft of the power tool) in order to provide for a static compensation of the masses. In order to also provide for an efficient dynamic compensation of the masses, the center of gravity of the counterweight(s) and the center of gravity of the backing pad are arranged as close as possible to each other. A perfect compensation could theoretically be achieved if the centers of gravity are both located on a common horizontal plane extending perpendicular to the center axis of the backing pad. Of course, this cannot be realized in practice due to technical constraints. However, the backing pad according to the invention provides for a much closer arrangement of the two centers of gravity in respect to each other and, therefore, for a very good dynamic compensation of the masses.

Summing up, the main advantages of the invention are the following:

- the center of gravity of the counterweight(s) is moved closer to the center of gravity of the backing pad in the axial direction,
- reduced momentum of the moving masses and in particular of the backing pad during intended use of the power tool,
- less vibrations of the power tool during its intended use,
- reduced overall height of the backing pad and of the power tool with the backing pad attached thereto, According to a preferred embodiment of the present invention, it is suggested that the surrounding external region of the top surface of the backing pad extends from the recessed central region radially outwards to an upper external edge of the top surface of the backing pad. A conical intermediate region may be provided between the recessed central portion and the surrounding external region, with the intermediate region rising from the central region towards the external region. Preferably, the surrounding external region has a continuous essentially horizontal extension throughout its entire surface. Although the surrounding external region may be provided with holes (e.g. for dust aspiration) and/or with elements protruding upwards from the surface (e.g. reinforcement ribs and/or venting blades), the extension of the surrounding external region is still regarded as being essentially horizontal. With other words, according to this embodiment, viewed in a cross section, the backing pad has essentially the same height in a first area, where the surrounding external region touches the central region or a conical intermediate region, and in a second area, where the surrounding external region touches the upper external edge of the top surface of the backing pad.

According to another preferred embodiment of the invention, it is suggested that the attachment member is at least partially made of metal and/or a rigid plastic material. Part of the metal and/or rigid plastic material may extend into the recessed central region of the top surface or even form the entire central region. In particular, the torque receiving and/or transmitting parts of the attachment member are made of the metal and/or the rigid plastic material. These are, for example, in an attachment member designed as a recess internal circumferential surfaces defining the recess. In an attachment member designed as a threaded pin, the pin or at least parts of its base extending immediately adjacent to the central region are preferably made of the metal and/or the rigid plastic material.

The attachment member may comprise essentially plate-like anchoring or embedding means having an essentially plate-like form, which may extend within the damping layer and/or the top surface of the backing pad. It is important that the attachment member be fixedly attached to the entire backing pad in order to be able to transfer torque received from a tool shaft or an eccentric element of the power tool into the backing pad. Although the attachment member is accessible from the top of the backing pad and, therefore, arranged on the top surface, in particular in the central region of the top surface, the attachment member may indeed extend through other parts of the backing pad, too.

According to a preferred embodiment of the present invention, it is suggested that the attachment member comprises a central recess, and preferably at least part of the recessed central region of the top surface of the backing pad forming an upper external edge of the recess. Hence, with other words, the upper external edge of the recess is recessed in respect to the surrounding external region.

According to a preferred embodiment of the present invention, it is suggested that in a view from above on the top surface of the backing pad, the central recess has an inner circumferential form comprising two circular arcs having a common center point located on the center axis and the same radius, the two circular arcs being located opposite to each other in respect to the center axis and the inner circumferential form of the recess further comprising two straight lines extending parallel to each other on opposite sides of the center axis and interconnecting the two circular arcs with each other. Preferably, the attachment element of the power tool in the form of the protrusion has a corresponding external circumferential form so that the protrusion can be inserted into the recess in an axial direction and held therein in a form-fit manner.

According to an alternative embodiment, it is suggested that the inner circumferential form of the central recess comprises a regular polygonal, in particular a regular hexagonal. Preferably, the attachment element of the power tool in the form of the protrusion has a corresponding regular polygonal external circumferential form so that the protrusion can be inserted into the polygonal recess in an axial direction and held therein in a form-fit manner.

It is suggested that the central recess is at least partially formed by means of external walls which extend upwards from the recessed central region of the top surface of the backing pad. In this embodiment the upper external edge of the recess is not formed by any part of the recessed central region of the top surface of the backing pad. Rather, starting from the recessed central region, the external walls extend in an upwards direction. The walls delimit the internal circumferential surface of the central recess. The walls may also extend partially into the backing pad, below the recessed central region. Preferably, a top edge of the external walls is located below an imaginary horizontal plane defined by the surrounding external region of the top surface of the backing pad.

According to an alternative embodiment of the present invention, it is suggested that the attachment member comprises a threaded pin having a longitudinal axis congruent with the center axis of the backing pad. The recessed central region preferably runs directly adjacent to the base of the threaded pin. Hence, the base of the threaded pin is recessed in respect to the imaginary horizontal plane defined by the surrounding external region of the top surface of the backing pad. In this case, the attachment element of the power tool (attached to the tool shaft or the eccentric element), respectively, may comprise a threaded hole having an internal diameter and thread corresponding to the external diameter and thread of the threaded pin.

The backing pad may be attached to the attachment element by means of a threaded connection. Preferably, the rotation direction for tightening the threaded connection between the backing pad and the attachment element is opposite to the direction of the working movement. This will reduce the risk of unintentionally loosening the threaded connection when the power tool is activated. Quite to the contrary, activation of the power tool will tighten the threaded connection.

It is suggested that a threaded region of the threaded pin to which the corresponding attachment element of the hand-held power tool, in particular of the tool shaft of the hand-held power tool, is attached, is located below the imaginary horizontal plane defined by the surrounding external region. In this embodiment, not only the base but also that part of the threaded pin, to which the attachment element of the power tool is attached to, when the backing pad is attached to the power tool, is located below the imaginary horizontal plane. The further part of the threaded pin towards the distal end may also be located below the imaginary plane or not. Preferably, the entire threaded pin up to its distal end is located below the imaginary horizontal plane.

According to yet another alternative, the attachment member of the backing pad may comprise a threaded hole. In that case, the attachment element of the power tool would comprise a threaded pin. The external diameter and thread of the attachment element corresponds to the internal diameter and thread of the attachment member.

In a view from above, the backing pad may have any desired form. Preferably, in a view from above on the top surface of the backing pad, the backing pad has a circular, a triangular, in particular a delta-shaped, or a rectangular form. A circular backing pad will preferably be attached to the power tool such that it will perform one of the following working movements: purely rotational (attached directly to the tool shaft), random orbital (attached to an eccentric element in a freely rotatable manner about its center axis), gear driven (attached to a gear arrangement, in particular a planetary gear) or eccentric (attached to an eccentric element and the backing pad being limited in its free rotation about the center axis in respect to the eccentric element). A triangular, delta-shaped or rectangular backing pad will preferably be attached to the power tool such that it will perform an eccentric working movement (attached to an eccentric element and the backing pad being limited in its free rotation about the center axis in respect to the eccentric element). The backing pad according to the present invention with the central region of the top surface being recessed in respect to the surrounding external region has the above mentioned advantages (i.e. reduced momentum of the moving masses and less vibrations) irrespective of the external form of the backing pad.

In the case of a circular backing pad, the recessed central region of the top surface has an essentially circular-shaped form and the surrounding external region has an essentially ring-shaped form.

According to a preferred embodiment of the invention, in a view from above on the top surface of the backing pad, the backing pad has a circular form and the top surface comprises a separate plate-like ring-shaped cover element made of a rigid material, wherein preferably at least part of the ring-shaped external region of the top surface, in particular at least a radially external part of the external region abutting against an upper external edge of the top surface of the backing pad, is made up of the separate plate-like ring-shaped cover element. For example, a ring-shaped cover element of this type is described in detail in EP 1 514 644 A1 and EP 2 551 056 A1 and essentially serves for creating additional suction chambers and channels in the backing pad for supporting a dust aspiration functionality of the backing pad and removing dust and small particles form the working surface with higher efficiency. According to this embodiment, the central region of the top surface is recessed in respect to the ring-shaped cover element. Hence, it would be advantageous to provide a fan of a dust extraction device of the power tool in the depression created by the recessed central region, as close as possible to the openings of the suction chambers and channels of the backing pad, thereby further enhancing dust aspiration efficiency.

The separate plate-like ring-shaped cover element is preferably fixedly attached to the rest of the top surface by means of at least one of gluing, welding, co-moulding, a snap-on connection, a magnetic connection, riveting and screwing.

BRIEF DESCRIPTION OF THE DRAWING

Further features and advantages of the present invention are described in more detail hereinafter with reference to the accompanying drawings. It is emphasized that each of the features shown in the drawings and described herein may be significant for the present invention, even if not explicitly mentioned herein. Furthermore, the features shown in the drawings and described herein may be combined with each other in any desired manner, even if that combination is not shown in the drawings and not explicitly mentioned herein. The drawings show.

DETAILED DESCRIPTION OF THE BEST MODE OF THE INVENTION

Figure 7:
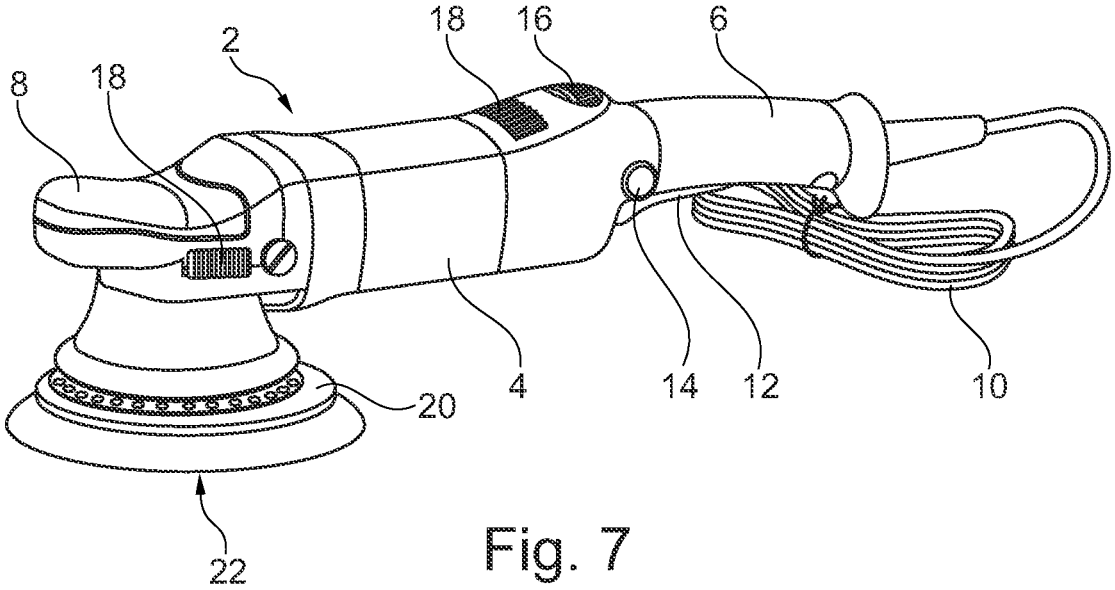
FIG. 7 a power tool with a backing pad according to the present invention attached thereto.

In FIG. 7 an example of a hand-guided and hand-held motor driven power tool is designated in its entirety with reference sign 2. In this example the power tool 2 is embodied as a random orbital polisher. However, the power tool could also be embodied as a rotary or a gear-driven polisher or as a sander, in particular an eccentric sander, or the like. The polisher 2 has a housing 4, essentially made of plastic material. The housing 4 has a handle 6 at its rear end and a grip portion 8 at its front end. An electric power supply line 10 with an electric plug at its distal end exits the housing 4 at the rear end of the handle 6. Hence, in this example, the polisher 2 is driven by an electric motor with electric current drawn from a mains power supply. Of course, the polisher 2 could also be operated with electric current drawn from an internal and/or extractable rechargeable battery of the polisher 2. Alternatively, the polisher 2 could comprise a pneumatic motor driven by compressed air drawn from a tube for compressed air attached to the housing 4 of the polisher 2. In the two latter cases, the electric cable 10 is not necessary and may be omitted.

At the bottom side of the handle 6 a switch 12 is provided for turning on and off the power tool 2. The switch 12 can be continuously held in its activated position by means of a push button 14. The power tool 2 can be provided with speed adjustment means 16 (e.g. a knurled wheel) for adjusting the rotational speed of the tool's motor. The housing 4 can be provided with cooling openings 18 for allowing heat from electronic or mechanical components and/or the electric motor located inside the housing 4 to dissipate into the environment and for allowing cooling air to enter the housing 4.

A backing pad 20 is attached to the power tool 2 in a manner which will be described in more detail below. A polishing or sanding member 24 for working a working surface (e.g. of a vehicle, boat or airplane body, or of a piece of wood, metal, plastic, resin or the like) may be attached to a bottom layer 22 of the backing pad 20 (see FIG. 8). The polishing member 24 may be, for example, a foam pad, a synthetic or natural wool pad, a microfiber pad, a leather pad or the like. The sanding member 24 may be, for example, an abrasive paper of fabric, an abrasive pad or the like. The releasable attachment of the polishing or sanding member 24 to the bottom layer 22 of the backing pad 20 may be effected by means of an adhesive connection or a hook-and-loop-connection or the like. To this end, the bottom layer 22 may comprise a first layer (with hooks or loops) of a hook-and-loop-connection and the top surface of the polishing or sanding member 24 may comprise a second layer (with loops or hooks) of the hook-and-loop-connection. The two layers with the hooks and loops enter into mutual interaction with each other when placing the polishing or sanding member 24 on the bottom layer 22, thereby releasably attaching the polishing or sanding member 24 to the backing pad 20.

Figure 8:
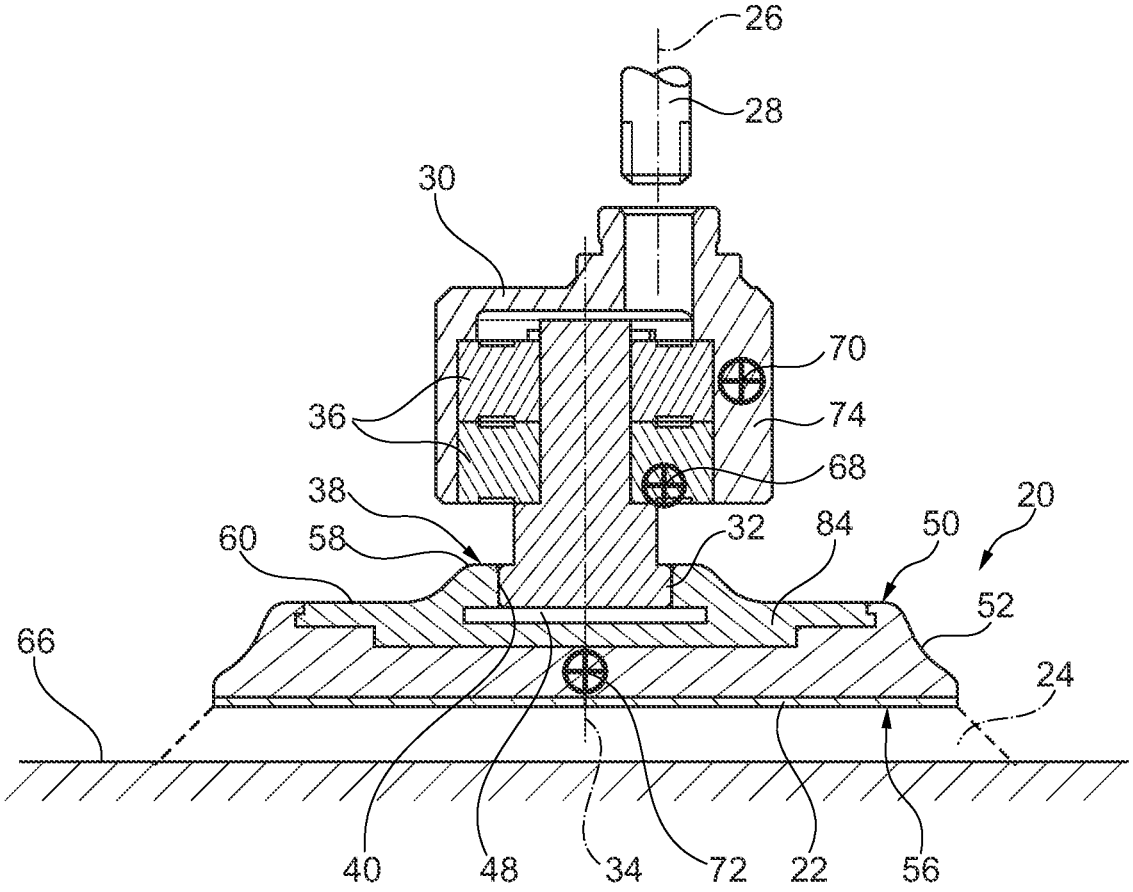
FIG. 8 a conventional backing pad indirectly attached to a tool shaft of a power tool by means of an eccentric element in a sectional view.
Figure 9:
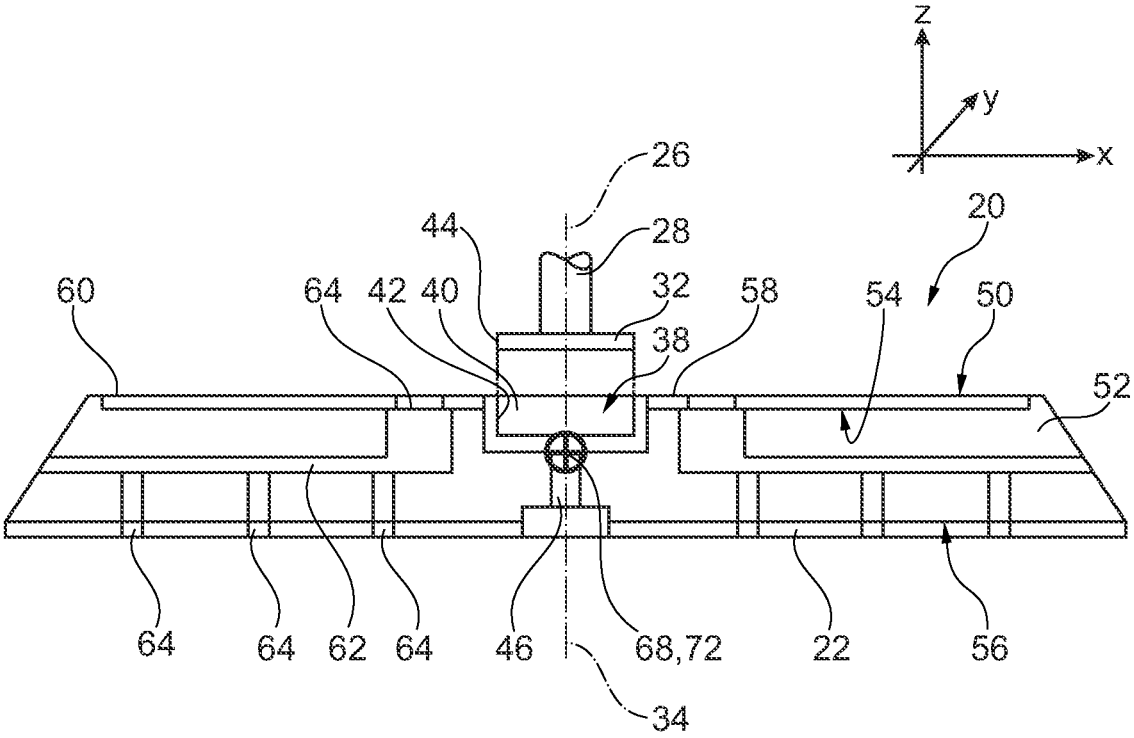
FIG. 9 a conventional backing pad directly attached to a tool shaft of a power tool in a sectional view.

The backing pad 20 is attached to the power tool 2 such that it rotates about a rotational axis 26 of a tool shaft 28 of the power tool 2. The example of FIG. 8 shows a conventional backing pad 20 indirectly attached to the tool shaft 28 by means of an eccentric element 30. In contrast thereto, FIG. 9 shows a conventional backing pad 20 directly attached to the tool shaft 28. In particular, the backing pad 20 is attached to an attachment element 32 which may be fixedly attached to or form part of the tool shaft 28 (see FIG. 9) of the power tool 2 or which may be attached to an eccentric element 30 in a freely rotatable manner (see FIG. 8).

If the backing pad 20 is directly attached to the tool shaft 28 of the power tool 2, it preferably performs a purely rotational working movement. In that case the attachment element 32 is attached to the tool shaft 28 in a torque proof manner or forms an integral part thereof.

If the backing pad 20 is attached to the tool shaft 28 by means of an eccentric element 30, it preferably performs a random orbital working movement. The eccentric element 30 is attached to the tool shaft 28 in a torque proof manner so as to rotate about the rotational axis 26 of the tool shaft 28 upon activation of the power tool 2. The attachment may be effected by means of a threaded connection, welding or the like. The backing pad 20 is attached to the eccentric element 30 in a manner freely rotatable about its center axis 34, e.g. by means of one or more bearings 36, which may have the form of ball races. The rotational axis 26 of the tool shaft 28 and the center axis 34 of the backing pad 20 extend parallel and in a distance to each other. When the power tool 2 is activated, the backing pad 20 performs an eccentric movement about the rotational axis 26 of the tool shaft 28. At the same time the free rotation of the backing pad 20 in respect to the eccentric element 30 adds a random rotational movement component of the backing pad 20 about the center axis 34 to the eccentric movement about the rotational axis 26, resulting in the random orbital working movement of the backing pad 20.

It can be seen from FIG. 8 that the eccentric element 30 has at least one counterweight 74 (the thicker walls on the right side of the eccentric element 30 in FIG. 8) to compensate for the weight of the backing pad 20 during the eccentric movement about the rotational axis 26. The counterweight 74 is located on a side of the eccentric element 30 in respect to the rotational axis 26 opposite to the center axis 34 and opposite to a center of gravity 72 of the backing pad 20.

The backing pad 20 comprises an attachment member 38 on its top surface 50, by means of which it is connected to the tool shaft 28 or the eccentric element 30. In the examples of FIGS. 8 and 9, the attachment member 38 comprises a recess 40 with a non-rotationally symmetric inner circumferential surface 42. The attachment element 32 has a corresponding outer circumferential surface 44. In particular, the attachment member 38 and the attachment element 32 are designed such that the attachment element 32 may be received by the attachment member 38 in a form fit manner in respect to the central axis 34 of the backing pad 20. To this end, a torque may be transmitted from the attachment element 32 to the backing pad 20, if desired. The backing pad 20 and the attachment member 38, respectively, may be held in an axial direction (parallel to the center axis 34) in respect to the attachment element 32 mechanically (see FIG. 9), e.g. by means of a screw, which may be inserted into a central hole 46 of the backing pad 20 from the bottom and screwed into a threaded hole (not shown) provided at the bottom of the attachment element 32 and possibly also in the tool shaft 28. Alternatively, the backing pad 20 and the attachment member 38, respectively, may be held in the axial direction in respect to the attachment element 32 magnetically (see FIG. 8), e.g. by means of a permanent magnet 48 attached to the backing pad 20, which interacts with a ferromagnetic element attached to or provided by the attachment element 32.

The backing pad 20 comprises:

the center axis 34, a top surface 50, a damping layer 52 made of resilient plastic material and attached to the top surface 50, in particular to a bottom surface 54 of the top surface 50, the even bottom layer 22 attached to a bottom surface 56 of the damping layer 52 and adapted for releasable attachment of the polishing or sanding member 24, and the attachment member 38 provided on the top surface 50 and adapted for releasable attachment to the corresponding attachment element 32 of the hand-held power tool 2.

The resilient plastic material of the damping layer 52 is preferably polyurethane (PUR) or a similar elastic and/or resilient plastic material. The various layers 50, 52 and 22 of the backing pad 20 may be glued together and/or manufactured in a co-moulding process. The attachment member 38 is preferably inserted into the backing pad 20 (i.e. into the top surface 50 and the damping layer 52) by means of a co-moulding process.

Backing pads 20 of the above-mentioned kind are well-known in the prior-art. Round backing pads 20 have a top surface 50 with a circular central region 58 extending around the center axis 34 and an essentially ring-shaped external region 60 surrounding the central region 58. In the known backing pads 20 the central region 58 either protrudes upwards beyond the surrounding external region 28 (see FIG. 8) or is on the same level as the surrounding external region 28 (see FIG. 9). The reason for the rather large thickness of the backing pad 20 in the area of the central region 58 is that it comprises the attachment member 38 of the backing pad 20. The attachment member 38 may be in the form of a threaded pin or a recess 40 adapted for receiving and being attached to the corresponding attachment element 32 of the power tool 2.

Further reasons for the rather large thickness of the known backing pads 20, in particular in the area of the central region 58, may be dust suction channels and chambers 62 provided in the damping layer 52, with openings 64 extending through the top surface 50 and the bottom layer 22.

One drawback of the conventional backing pads 20 having an elevation in the central region 58 of the top surface 50 or having at least the central region 58 level with the surrounding external region 60 and with the attachment member 38 located in the central region 58, is that the center of gravity 68 of the entire moving masses is located rather high above a surface 66 to be worked by means of the power tool 2 and the polishing or sanding member 24, respectively. Furthermore, the center of gravity 70 of the counterweight(s) 74 and the center of gravity 72 of the backing pad 20 are located at a rather large distance in the axial direction in respect to each other. The result is that the power tool 2 has an unsteady and uneven running and creates a rather large amount of vibrations during intended use of the power tool 2.

These drawbacks are overcome by the backing pad 2 according to the present invention, examples of which are shown in their entirety or in part in FIGS. 1-6. In particular, it is suggested that the central region 58 of the top surface 50 is recessed in respect to the surrounding external region 60, and that the attachment member 38 is provided in the recessed central region 58 with the center axis 34 extending through the attachment member 38 and at least part of the central region 58 surrounding the attachment member 38. Preferably, at least part of the recessed central region 58 of the top surface 50 of the backing pad 20 abuts directly against the attachment member 38, e.g. forming an upper external edge of the recess 40 or surrounding a base of the threaded pin 78 in a collar-like manner.

Figure 1:
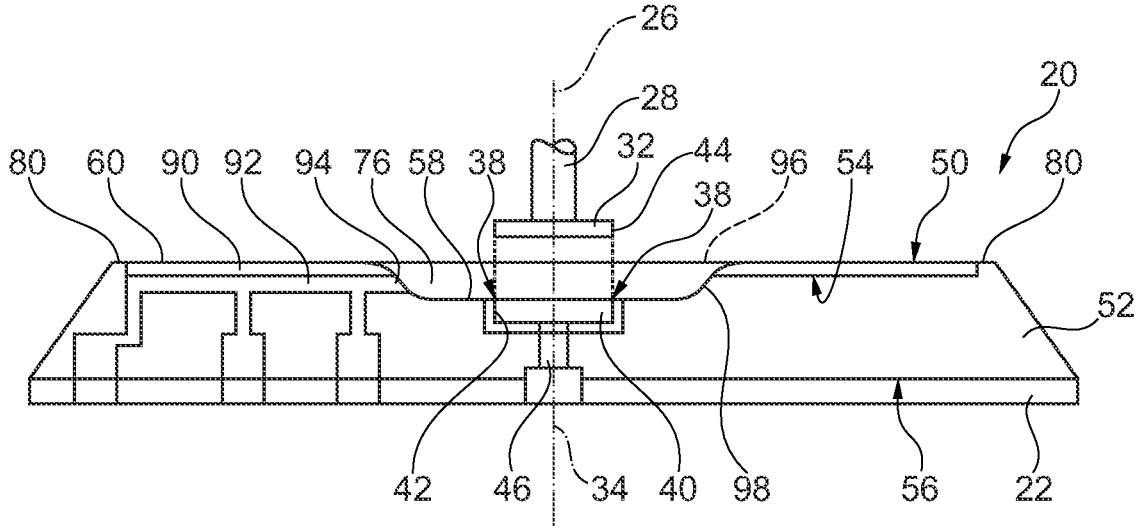
FIG. 1 a backing pad according to a preferred embodiment of the present invention directly attached to a tool shaft of a power tool in a sectional view.
Figure 2:
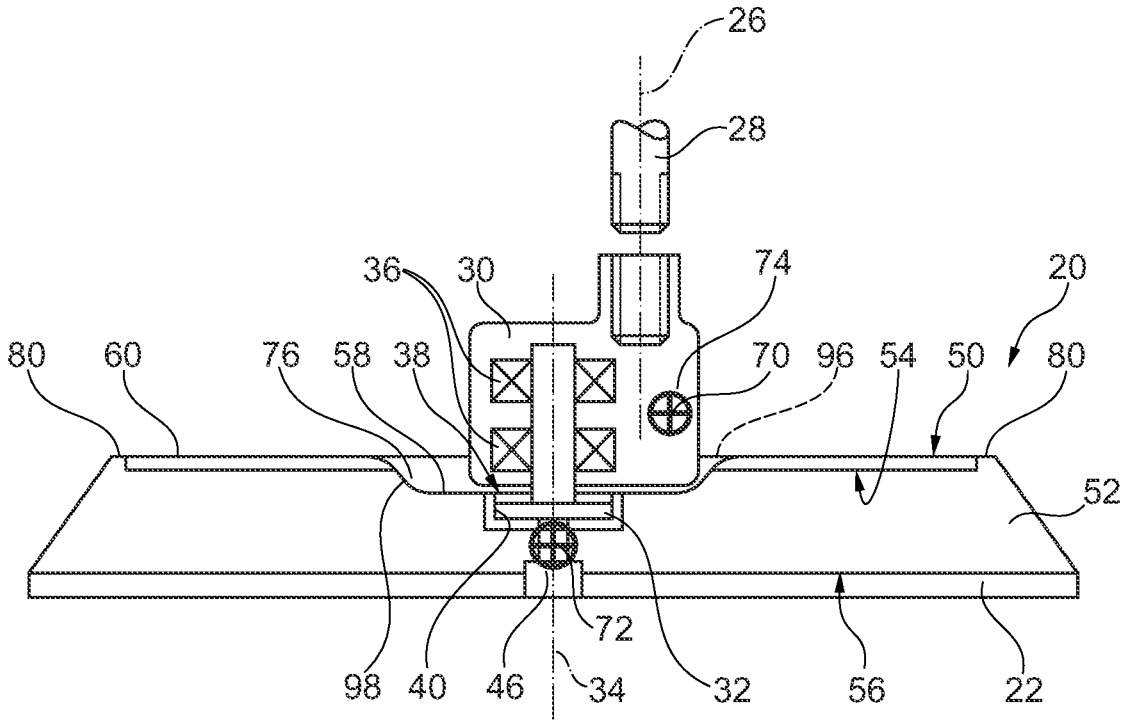
FIG. 2 a backing pad according to a preferred embodiment of the present invention indirectly attached to a tool shaft of a power tool by means of an eccentric element in a sectional view.
Figure 3:
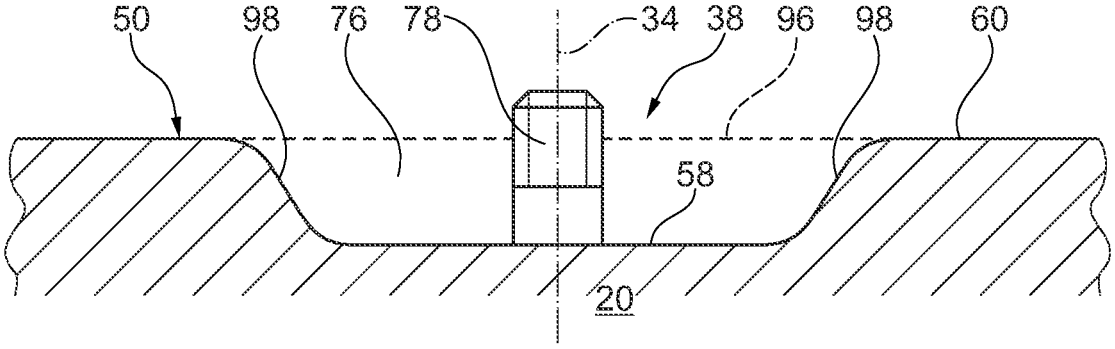
FIG. 3 a detailed view of an attachment member of a backing pad according to a first embodiment of the present invention in a side view.
Figure 4:
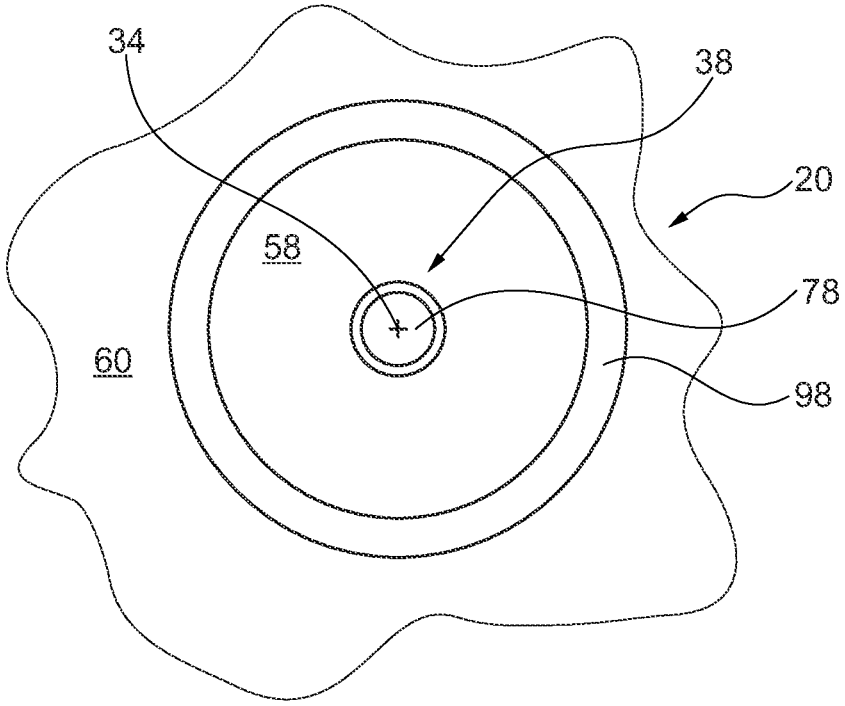
FIG. 4 the attachment member of FIG. 3 in a top view.
Figure 5:
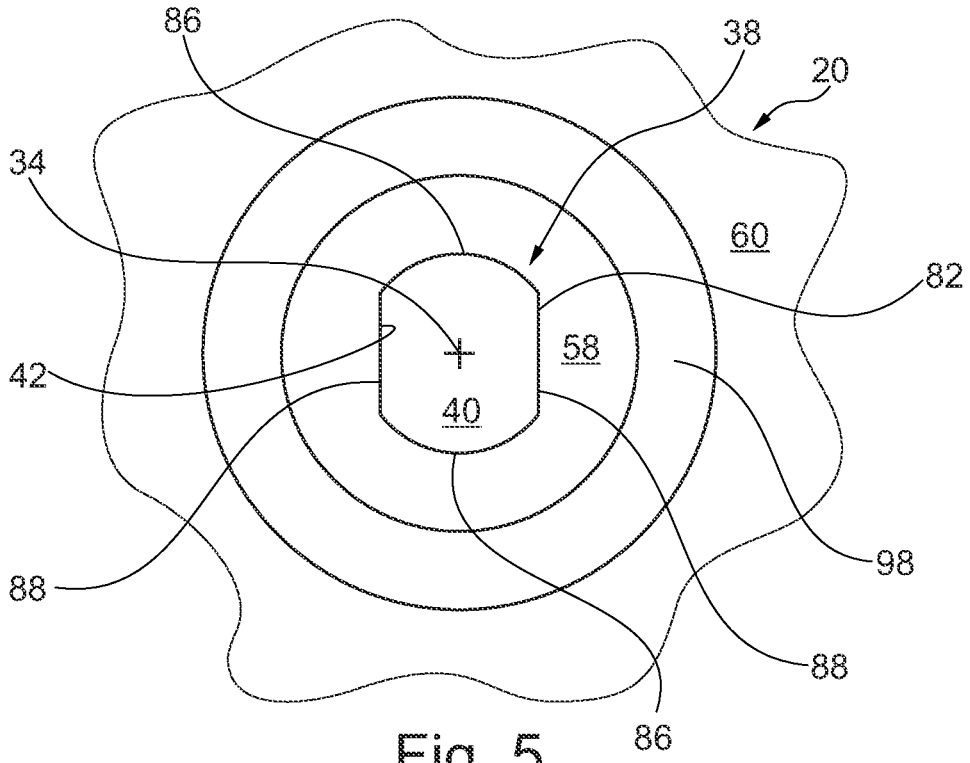
FIG. 5 a detailed view of an attachment member of a backing pad according to a second embodiment of the present invention in a top view.
Figure 6:
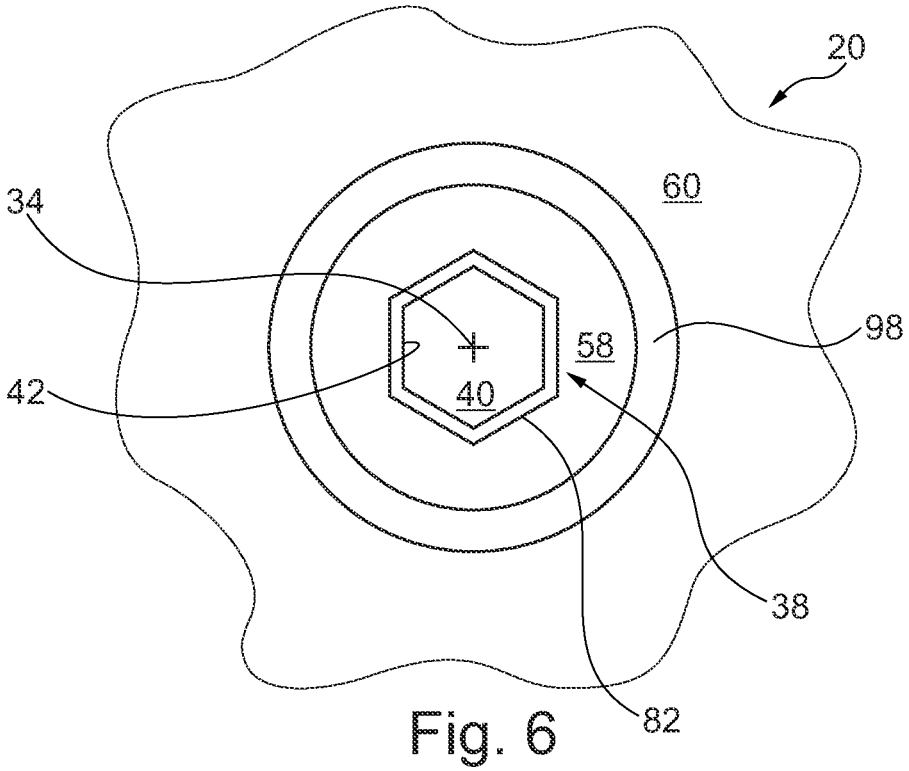
FIG. 6 a detailed view of an attachment member of a backing pad according to a third embodiment of the present invention in a top view.

In contrast to the prior-art backing pads 20 of FIGS. 8 and 9, where the center region 58 protrudes beyond or is level to the surrounding external region 60 in an axial direction (parallel to the center axis 34), in the present invention, the center region 58 is recessed in respect to the surrounding external region 60 (see FIGS. 1 and 2). This allows an arrangement of the attachment member 38 of the backing pad 20 much lower and deeper in the backing pad 20 closer towards the bottom layer 22. Hence, the backing pad 20 may be arranged much closer to the power tool 2, thereby reducing the distance between moving masses of the power tool 2. In particular, the eccentric element 30 with the counterweight 74 can be positioned much closer to the center of gravity 72 of the backing pad 20, preferably even at least partially within a depression 76 formed in the top surface 50 by the recessed central region 58. The result is that the power tool 2 with the backing pad 20 according to the present invention attached thereto and the polishing or sanding member 24 attached to the backing pad 20 has a much steadier and more even running and creates by far less vibrations during intended use of the power tool 2.

The counterweight 74 essentially corresponds to the weight of the backing pad 20 and possibly also of the polishing or sanding member 24 attached thereto. It is arranged opposite to the center of gravity 72 of the backing pad 20 in respect to the rotational axis 26 of the tool shaft 28 of the power tool 2 in order to provide for a static compensation of the masses. In order to also provide for an efficient dynamic compensation of the masses, the center of gravity 70 of the counterweight(s) 74 and the center of gravity 72 of the backing pad 20 are arranged as close as possible in respect to each other in an axial direction. Theoretically, a perfect dynamic compensation could be achieved if the centers of gravity 70, 72 were located on a common horizontal plane. Of course, this cannot be realized in practice due to technical constraints. However, the backing pad 20 according to the invention provides for a much closer arrangement of the two centers of gravity 70,72 in the axial direction and, therefore, for a very good dynamic compensation of the masses.

It is suggested that the top surface 50 of the backing pad 20 and in particular the depression 76 is designed such that it can receive part of an eccentric element 30 if the backing pad 20 is indirectly attached to the tool shaft 28 by means of the eccentric element 30. This can be seen in FIG. 2, where it is clearly visible that the bottom part of the eccentric element 30 is located within the depression 58 and below an imaginary horizontal plane 96 defined by the surrounding external region 60. Similarly, in the case where the backing pad 20 is directly attached to the tool shaft 28 (see FIG. 1), the bottom part of the tool shaft 28 immediately adjacent to the attachment element 32 is located within the depression 76 and below the imaginary horizontal plane 96.

As previously mentioned, the attachment member 38 of the backing pad 20 may comprise a recess 40 (see FIGS. 1 and 2). In that case, the attachment element 32 is preferably formed by a protrusion having an external circumferential surface 44 with a form corresponding to the form of the internal circumferential surface 42 of the recess 40, so that the protrusion 32 can be inserted into the recess 40 in an axial direction in a form-fit manner. The protrusion 32 may be held in the recess 40 in the axial direction mechanically or magnetically, as previously described. Preferably, the external circumferential surface 44 of the protrusion 32 and the internal circumferential surface 42 of the recess 40 are not rotationally symmetric in respect to the center axis 34 of the backing pad 20. In this manner, after insertion of the protrusion 32 into the recess 40 in the axial direction, they are connected to each other in a torque proof manner in respect to the center axis 34 of the backing pad 20. To this end, a torque can be transmitted from the attachment element 32 to the backing pad 20, if desired.

It is suggested that in a view from above on the top surface 50 of the backing pad 20 (see FIG. 5), the central recess 40 has an inner circumferential surface 42 comprising two circular arcs 86 having a common center point located on the center axis 34 and having the same radius, the two circular arcs 86 being located opposite to each other and in the same distance in respect to the center axis 34. The inner circumferential surface 42 further comprises two straight lines 88 extending parallel to each other on opposite sides of the center axis 34 equidistant to the center axis 34 and interconnecting the two circular arcs 86 with each other. The attachment element 32 of the power tool 2 in the form of the protrusion would have a corresponding external circumferential surface 44 so that the protrusion 32 can be inserted into the recess 40 in an axial direction and held therein in a form-fit manner.

According to an alternative embodiment (see FIG. 6), it is suggested that the form of the inner circumferential surface 42 of the central recess 40 comprises a regular polygonal, in particular a regular hexagonal. Preferably, the attachment element 32 of the power tool 2 in the form of the protrusion has a corresponding regular polygonal external circumferential form so that the protrusion 32 can be inserted into the recess 40 in an axial direction and held therein in a form-fit manner.

It is suggested that the central recess 40 is at least partially formed by means of external walls 82 (see FIG. 6) which extend upwards from the central region 58 of the top surface 50 of the backing pad 20. In this embodiment the upper external edge of the recess 40 or of the walls 82, respectively, is not formed by any part of the recessed central region 58 of the top surface 50. Rather, starting from the recessed central region 58, the walls 82 extend in an upward direction. The walls 82 delimit the internal circumferential surface 42 of the central recess 40. The external walls 82 may also extend partially into the backing pad 20, below the recessed central region 58. Preferably, a top edge of the external walls 82 is located below the imaginary horizontal plane 96 defined by the surrounding region 60 of the top surface 50.

Alternatively, the attachment member 38 may comprise a threaded pin 78 (see FIGS. 3 and 4) having a longitudinal axis congruent with the center axis 34 of the backing pad 20. In that case, the attachment element 32 of the power tool 2 comprises a threaded hole having an internal diameter and thread corresponding to an external diameter and thread of the threaded pin 78. The backing pad 20 may be attached to the attachment element 32 by means of a threaded connection. It can be seen from FIG. 3 that the attachment element 32 if attached to a threaded region of the threaded pin 78, is at least partially located within the depression 76 and below the imaginary horizontal plane 96 defined by the surrounding external region 60. In particular, the entire threaded region of the threaded pin 78, is located below the imaginary horizontal plane 96. It would even be possible, that the entire threaded pin 78 including its distal end is located below the imaginary horizontal plane 96.

Preferably, the rotation direction for tightening the threaded connection between the backing pad 20 and the threaded pin 78, respectively, and the power tool 2 and the attachment element 32, respectively, is opposite to the direction of the rotational working movement about the rotational axis 26 of the tool shaft 28. This will reduce the risk of unintentionally loosening the threaded connection when the power tool 2 is activated and the backing pad 20 is accelerated. Quite to the contrary, activation of the power tool 2 will tighten the threaded connection.

The surrounding external region 60 of the top surface 50 of the backing pads 20 according to the invention extends from the recessed central region 58 radially outwards to an upper external edge 80 of the top surface 50. A conical intermediate region 98 may be provided between the recessed central portion 58 and the surrounding external region 60, with the intermediate region 58 rising from the central region 58 towards the external region 60.

Preferably, the surrounding external region 60 has a continuous essentially horizontal extension throughout its entire surface. Although the surrounding external region 60 may be provided with holes and/or with protruding elements (e.g. reinforcement ribs, venting elements or the like) on its surface, the extension of the surrounding external region 60 is still considered to be essentially horizontal in the sense of the present invention. With other words, it is suggested that, viewed in a cross section, the backing pad 20 has essentially the same height in a first area where the surrounding external region 60 touches the central region 58 or the intermediate region 98 and in a second area where the surrounding external region 60 touches the upper external edge 80 of the top surface 50 of the backing pad 20.

It is suggested that the attachment member 38 is at least partially made of metal (e.g. die-cast aluminium or steel) and/or a rigid plastic material (e.g. polyvinyl chloride (PVC), polyethylene (PE), polycarbonate (PC), a resin, possibly fibre enforced, or the like). In particular, the torque receiving and/or transmitting parts of the attachment member 38 are made of metal and/or the rigid plastic material. These are, for example, in an attachment member 38 designed as a recess 40, circumferential walls 82 (see FIGS. 5 and 6) defining the internal circumferential surface 42 of the recess 40, or part of the walls 82. In an attachment member 38 designed as a threaded pin 78 (see FIGS. 3 and 4), the entire pin 78, a threaded region and/or parts of the pin's base extending immediately adjacent to the central region 58 are preferably made of metal and/or the rigid plastic material.

Of course, at least part of the central region 58 can be also made of metal and/or a rigid plastic material, preferably in one piece with the attachment member 38 (i.e. the walls 82 or the threaded pin 78). The attachment member 38 may comprise anchoring or embedding means 84 having an essentially plate-like form (see FIG. 8), which may extend within the damping layer 52 of the backing pad 20. Although the attachment member 38 is accessible from the top of the backing pad 20 and, therefore, arranged in the top surface 50, the attachment member 38 may indeed extend through other parts, e.g. the damping layer 52, of the backing pad 20, too.

The backing pad 20 shown in the FIGS. 1 and 2 has a circular form. In general, it may have any desired form. Preferably, in a view from above on the top surface 50 of the backing pad 20, the backing pad 20 has a circular, a triangular, in particular a delta-shaped, or a rectangular form. A circular backing pad 20 will preferably be attached to the power tool 2 such that it will perform one of the following working movements: purely rotational (attached directly to the tool shaft 28), random orbital (attached to an eccentric element 30), gear driven (attached to an gear arrangement, in particular a planetary gear) or an eccentric (attached to an eccentric element 30 and the backing pad 20 being limited in its free rotation in respect to the eccentric element 30 about its center axis 34). In the case of a circular backing pad 20, the recessed central region 58 of the top surface 50 has an essentially circular-shaped form and the surrounding external region 60 has an essentially ring-shaped form.

A triangular, delta-shaped or rectangular backing pad 20 will preferably be attached to the power tool 2 such that it will perform an eccentric working movement (attached to an eccentric element 30 and the backing pad 20 being limited in its free rotation in respect to the eccentric element 30 about its center axis 34).

It is further suggested that in a view from above on the top surface 50 of the backing pad 20, the backing pad 20 has a circular form and the top surface 50 comprises a separate plate-like ring-shaped cover element 90 made of a rigid material. Preferably, at least part of the ring-shaped external region 60 of the top surface 50, in particular at least a radially external part of the external region 60 abutting against the upper external edge 80 of the top surface 50 of the backing pad 20, is made up of the ring-shaped cover element 90 (see the left part of the backing pad 20 in FIG. 1). The ring-shaped cover element 90 serves for creating additional suction chambers and channels 92 in the backing pad 20 for supporting dust extraction functionality of the backing pad 20 and removing dust and small particles form the working surface 66 with higher efficiency, in particular when the backing pad 20 is attached to a sanding power tool 2. In this embodiment, it would be advantageous to provide a fan of an internal dust extraction device of the power tool 2 in the depression 76, as close as possible to openings 94 of the suction chambers and channels 92 of the backing pad 20, thereby further enhancing dust aspiration efficiency.

The separate plate-like ring-shaped cover element 90 is preferably fixedly attached to the rest of the top surface 50 by means of at least one of gluing, welding, co-moulding, a snap-on connection, a magnetic connection, riveting and screwing.

The invention claimed is:

1. A plate-like backing pad (20) adapted for releasable attachment to a tool shaft (28) or an eccentric element (30) of a hand-held polishing or sanding power tool (2), the plate-like backing pad (20) comprising:

a center axis (34), a top surface (50) limiting the plate-like backing pad (20) in a top direction, a bottom surface (56) limiting the plate-like backing pad (20) in a bottom direction, a damping layer (52) made of an elastic or resilient plastic material, including polyurethane, and located between the top surface (50) and the bottom surface (56), an even bottom layer (22) attached to the bottom surface (56) and adapted for releasable attachment of a polishing or sanding member (24), and an attachment member (38) having a central recess (40) with a non-rotationally symmetric inner circumferential surface (42) provided in the top surface (50) and adapted for releasable attachment to a corresponding attachment element (32) of the tool shaft (28) or the eccentric element (30) of the hand-held polishing or sanding power tool (2), wherein the top surface (50) has a central region (58) extending around the center axis (34) and is surrounded by, and recessed with respect to, an external region (60) so as to form a depression (76) below a horizontal plane (96) defined by the external region (60), the central region (58) and the external region (60) both being part of the top surface (50) and limiting the plate-like backing pad (20) in the top direction, and the attachment member (38) is provided in the central region (58) of the top surface (50) in the depression (76) entirely below the horizontal plane (96) defined by the external region (60) of the top surface (50) with the center axis (34) extending through the attachment member (38) and the central region (58) surrounding the attachment member (38).

2. The plate-like backing pad (20) according to claim 1, wherein the external region (60) of the top surface (50) of the plate-like backing pad (20) extends from the central region (58) radially outwards to an upper external edge (80) of the top surface (50) of the plate-like backing pad (20).

3. The plate-like backing pad (20) according to claim 2, wherein the attachment member (38) is at least partially made of metal and/or a rigid plastic material.

4. The plate-like backing pad (20) according to claim 2, wherein at least part of the central region (58) of the top surface (50) of the plate-like backing pad (20) forms an upper external edge of the central recess (40).

5. The plate-like backing pad (20) according to claim 1, wherein the attachment member (38) is at least partially made of metal and/or a rigid plastic material.

6. The plate-like backing pad (20) according to claim 1, wherein at least part of the central region (58) of the top surface (50) of the plate-like backing pad (20) forms an upper external edge of the central recess (40).

7. The plate-like backing pad (20) according to claim 6, wherein the central recess (40) comprises an inner circumferential surface (42) having a regular polygon, including a regular hexagon.

8. The plate-like backing pad (20) according to claim 6, wherein the central recess (40) is at least partially formed by means of external walls (82) which extend upwards from the central region (58) of the top surface (50) of the plate-like backing pad (20).

9. The plate-like backing pad (20) according to claim 8, wherein a top edge of the external walls (82) is located below an imaginary plane (96) defined by the external region (60) of the top surface (50) of the plate-like backing pad (20).

10. The plate-like backing pad (20) according to claim 1, wherein in a view from above on the top surface (50) of the plate-like backing pad (20), the plate-like backing pad (20) has a circular shape, a triangular shape, including being delta-shaped or a rectangular shape.

11. The plate-like backing pad (20) according to claim 1, wherein in a view from above on the top surface (50) of the plate-like backing pad (20), the plate-like backing pad (20) has a circular shape; and the central region (58) of the top surface (50) has a substantially circular-shaped form and the external region (60) has a substantially ring-shaped form.

12. The plate-like backing pad (20) according to claim 1, wherein in a view from above on the top surface (50) of the plate-like backing pad (20), the plate-like backing pad (20) has a circular shape;

the top surface (50) comprises a separate plate-like ring-shaped cover element (90) made of a rigid material; and at least part of the external region (60) of the top surface (50), including at least a radial external part of the external region (60) abutting against an upper external edge (80) of the top surface (50) of the plate-like backing pad (20), is made up of the separate plate-like ring-shaped cover element (90).

13. The plate-like backing pad (20) according to claim 12, wherein the separate plate-like ring-shaped cover element (90) is fixedly attached to a remaining part of the top surface (50) by means of at least one of gluing, welding, a snap-on connection, a magnetic connection, riveting, and screwing.

14. The plate-like backing pad (20) according to claim 1, wherein the inner circumferential surface (42) of the central recess (40) comprises a regular polygon, including a regular hexagon.

* * * * *